United States Patent [19]

Hinoda et al.

[11] 4,432,844

[45] Feb. 21, 1984

[54] PROCESS FOR REGENERATION OF ELECTROLYTE CONTAINING TIN SALTS BY REDUCING THE SAME

[75] Inventors: Yuji Hinoda; Kazuhiro Enmoto, both of Kawasaki, Japan

[73] Assignee: Fujisash Company, Kawasaki, Japan

[21] Appl. No.: 348,050

[22] PCT Filed: Jun. 23, 1980

[86] PCT No.: PCT/JP80/00141

§ 371 Date: Jan. 28, 1982

§ 102(e) Date: Jan. 28, 1982

[87] PCT Pub. No.: WO82/00036

PCT Pub. Date: Jan. 7, 1982

[51] Int. Cl.[3] ..... C25D 21/18

[52] U.S. Cl. ..... 204/54 R; 204/DIG. 13

[58] Field of Search ..... 204/54 R, DIG. 13; 423/89, 98

[56] References Cited

U.S. PATENT DOCUMENTS 4,181,580 1/1980 Kitayama et al. ..... 204/28

FOREIGN PATENT DOCUMENTS 51-39542 4/1976 Japan ..... 204/54 R 52-89536 7/1977 Japan .

53-110928 9/1978 Japan ..... 204/DIG. 13

OTHER PUBLICATIONS

S. Baier, *Electro-Tinning*, International Tin Research and Development Council, Middlesex, England, 1939 pp. 11-12.

*Primary Examiner*—G. L. Kaplan

*Assistant Examiner*—William Leader

*Attorney, Agent, or Firm*—Frishauf, Holtz, Goodman & Woodward

[57] ABSTRACT

Process for reclaiming stannous ion by reducing the same in an electrolyte to stannic ion through a simple operation in a short period of time, which comprises the steps of preparing the electrolyte in an acidic range as required and then adding metallic tin to the electrolyte and heating the mixture to at least 80° C., in order to reduce the stannous ion oxidized in the electrolyte containing tin salt to obtain a stable electrolyte treated product. This process may be utilized particularly for effectively reducing and reclaiming an electrolyte which contains tin salt used for electrolytically coloring aluminum.

4 Claims, No Drawings

PROCESS FOR REGENERATION OF ELECTROLYTE CONTAINING TIN SALTS BY REDUCING THE SAME

TECHNICAL FIELD OF THE INVENTION

This invention relates to a process for the reduction regeneration of an electro-plating bath or a coloring electrolyte for aluminum and more particularly to a process for the regeneration of an electrolyte by reducing stannic ions in the electrolyte into stannous ions through the addition of metallic tin to the used or old electrolyte.

BACKGROUND OF THE INVENTION

A tin salt aqueous solution containing stannous ions ($Sn^{2+}$) is generally used as an electrolyte containing tin ions. This aqueous solution containing stannous ions is very unstable since stannous ions are easily exidized into stannic ions ($Sn^{4+}$) by oxygen in the air or oxygen generated during electrolysis.

As such stannic ions form in the electrolyte, the concentration of stannous ions in the electrolyte decreases and the current efficiency of electrolysis is reduced. Furthermore, it gives rise to the serious problem that the stannic ions become insoluble substances such as stannic acid, etc. which are likely to become colloids and therefore great difficulty is encountered in removing such insoluble substances by filteration. These insoluble substances attach onto the surface of the product and cause pitting thereon.

Therefore, in order to obtain good quality products, it is essential to control the concentration of stannic ions in the electrolyte.

With regard to preventing insoluble precipitates from forming, it is effective to add a chelating agent to the electrolyte to dissolve $Sn^{4+}$. In this case, however, $Sn^{4+}$ is accumulated in the electrolyte, leading to an increase in the concentration of $Sn^{4+}$ and, as a result, electrolytic coloring or electro-plating tend to become difficult. Therefore, a tin salt aqueous solution in which the concentration of stannic ions has increased by oxidation has had to be abandoned.

The regeneration of the electrolyte by the reduction thereof has been effected. One of such regeneration methods is an electrolytic reduction method as described in Japanese Patent Publication No. 19856/1978. In accordance with this electrolytic reduction method of stannous ions and stannic ions which are present in the electrolyte, the stannous ions are first reduced into metallic tin and thereafter the stannic ions are reduced into metallic tin. Therefore, although this method is excellent, a very long processing time is required and equipment and operation costs are increased.

Additionally, as the regeneration method of an electrolyte, a method of reducing stannic ions into stannous ions by adding those metals which are baser than tin has been carried out. According to this method, however, since the added metal is present in the electrolyte as a metal ion, it may exert bad influences on electrolytic processing. It is, therefore, necessary to remove such metal ions, but the removal operation of the metal ions is very complicated. Thus this method is not preferred from practical and economic standpoints.

The inventors have studied to develop a method which removes the disadvantages in the prior art as described above and which permits the reduction of stannic ions by a simplified procedure in a short time and the formation of a regenerated electrolyte having a stable composition. As a result, it has been found that when metallic tin is added as a reducing agent to the electrolyte, as necessary, after the pH of the electrolyte has been controlled to the acidic region, the metallic tin and stannic ions undergo the oxidation-reduction reaction, promptly both changing into stannous ions.

DISCLOSURE OF THE INVENTION

This invention provides a process for the regeneration of an electrolyte containing tin salts by reduction thereof which is characterized in that in regenerating the electrolyte by reducing stannic ions therein into stannous ions, metallic tin is added to the electrolyte as it is or after the pH of the electrolyte is controlled to the acidic region and the resulting electrolyte is heated.

In accordance with the process of this invention, the stannic ions in the electrolyte are regenerated into stannous ions. After the reaction is completed, the unreacted metallic tin is taken out of the electrolyte and, as necessary, additional processings such as adjustment in the concentrations of other components in the electrolyte, adjustment in pH, etc. are applied. The thus regenerated electrolyte can be re-used.

When the above processings are continuously carried out, the electrolyte can be repeatedly used by recycling. Furthermore, in accordance with the process of this invention, the processing can be continuously carried out and the processing time can be greatly shortened. For example, in the method as described in Japanese Patent Publication No. 19856/1978, the time required for the reduction of the stannic ions is 6 hours or more whereas in the process of this invention, it is 1 hour or less and usually sufficient to be about 30 minutes.

Additionally, equipment and operation costs can be lessened and the quality of the product obtained by using the regenerated electrolyte can be stabilized.

PREFERRED EMBODIMENTS OF THE INVENTION

The electrolyte for use in this invention is subject to no special limitations so long as it contains tin salts. In a fresh electrolyte, almost all of the tin ions are stannous ions and there are almost no stannic ions. As the electrolysis proceeds, the concentration of stannic ions increases whereas the concentration of stannous ions relatively decreases.

The process of this invention is applied to an electrolyte in which the concentration of stannic ions has increased to a certain extent, for example, the ratio of $Sn^{4+}/Sn^{2+}$ has reached $\frac{1}{2}$ or more. In general, the electrolyte contains a chelating agent in order to keep the stannous and stannic ions in the state that they are dissolved.

Hereinafter the process of this invention will be explained in greater detail:

First, the pH of the electrolyte is controlled to the acidic region. This control is not always required when the pH of the electrolyte is already in the acidic region. However, when it is weak acidic or alkaline it is necessary to lower the pH to the acidic region.

This control in the pH of the electrolyte is generally carried out by using acids. Those acids releasing the same anions as those exisiting in the electrolyte, such as sulfuric acid, hydrochloric acid, phosphoric acid, nitric acid, pyrophosphoric acid or various organic acids can be used singly or in admixtures comprising two or more thereof. In the process of this invention, sulfuric acid is most preferable.

The pH of the electrolyte is usually controlled to 4 or less and preferably to the range of from 0.5 to 2. Where the pH is too low, the reduction rate of stannic ions is somewhat reduced although metallic tin is promptly dissolved. On the other hand, where the pH exceeds 4, metallic tin is less dissolved and the reduction does not proceed promptly.

Thereafter, metallic tin is added to the electrolyte of which the pH has been controlled to the acidic region and the resulting electrolyte is heated. In this case, it is preferred to add metallic tin having high activity. For example, those having large specific surface areas, such as fine powder, tin foils, sponges, etc. are preferably used.

Metallic tin having such a high specific surface area can be produced as follows:

An acidic solution (e.g., an electro-plating solution or a coloring electrolyte for aluminum) containing stannous ions and/or stannic ions is used as an electrolyte and a direct current is passed through the electrolyte with electrically conductive materials such as metal or carbon as anode and cathode whereby tin ions ($Sn^{2+}$, $Sn^{4+}$) are deposited as metallic tin on the cathode. The thus obtained metallic tin is in a sponge form, has a high specific surface area and can be easily separated from the cathode.

The amount of the metallic tin added to the electrolyte is not limited and can be suitably determined depending upon the concentration of stannic ions in the electrolyte, the required concentration of stannous ions, etc. In general, it should be about 1 to 10 time moles of the amount required entirely to reduce stannic ions in the electrolyte. Even if the metallic tin is excessively added, the unreacted metallic tin precipitates in the bottom of the reactor and can easily be separated. Therefore, it imposes no specific hindrance onto the electrolyte and the metallic tin so separated can be re-used as it is.

In the process of this invention, it is required to heat the electrolyte to which the metallic tin has been added. The addition of metallic tin causes the oxidation-reduction reaction as illustrated below wherein the metallic tin and stannic ions react with each other, both forming stannous ions.

$$Sn + Sn^{4+} \rightarrow 2Sn^{2+}$$

Since the reaction is accelerated by heating, it is preferred from the standpoint of acceleration of reaction to heat the electrolyte. However, where the electrolyte may be deteriorated in quality at high temperatures, the electrolyte to which metallic tin is added should be processed at low temperatures. From such standpoint, the heating temperature is generally set in the range of from 80° C. to the boiling temperature of the electrolyte.

With regard to the heating time, it is sufficient that the reduction reaction proceeds to the desired extent. While the heating time cannot be determined unconditionally since it varies depending upon the shape and amount of the metallic tin to be added and other various conditions, it is usually sufficient to be 1 hour or less.

The following examples are given to illustrate this invention in greater detail. In these examples, the concentration of stannic sulfate is shown as a concentration converted to $SnSO_4$.

EXAMPLE 1

(1) Production of Metallic Tin

A direct current was passed through an old or used coloring electrolyte for aluminum consisting of 9.0 grams/liter of stannous sulfate, 11.1 grams/liter of stannic sulfate, 70 grams/liter of citric acid and 20 grams/liter of sulfuric acid and having a pH of 1.5 with tin and stainless steel as anode and cathode respectively to deposite sponge-like metallic tin on the cathode.

(2) Regeneration by Reducing

To an old or used coloring electrolyte for aluminum consisting of 4.0 grams/liter of stannous sulfate, 15.1 grams/liter of stannic sulfate, 30 grams/liter of tartaric acid, 30 grams/liter of nickel sulfate and 20 grams/liter of ammonium sulfate and having a pH of 7.5 was added 40 grams/liter of sulfuric acid to adjust the pH to 0.9. Thereafter, 18 grams/liter of the sponge-like metallic tin as obtained in (1) was added to the above electrolyte and the resulting mixture was heated for 20 minutes at 100° C. After heating, the obtained electrolyte contained 21.2 grams/liter of stannous sulfate and 0.7 gram/liter of stannic sulfate.

EXAMPLE 2

To an old or used neutral tin electro-plating solution consisting of 41 grams/liter of stannous sulfate, 89 grams/liter of stannic sulfate, 150 grams/liter of ammonium citrate and 100 grams/liter of ammonium sulfate and having a pH of 6.5 was added 60 grams/liter of sulfuric acid to adjust the pH to 0.7. Thereafter, 148 grams/liter of the sponge-like metallic tin as obtained in Example 1 was added to the plating solution and the resulting mixture was heated at 96° C. for 40 minutes. After heating, the obtained plating solution contained 222 grams/liter of stannous sulfate and 8 grams/liter of stannic sulfate.

EXAMPLE 3

To an old or used lustrous tin-cobalt electro-plating solution consisting of 10 grams/liter of stannous sulfate, 10 grams/liter of stannic sulfate, 50 grams/liter of cobalt sulfate and 200 grams/liter of sodium pyrophosphate was added 60 grams/liter of sulfuric acid. Thereafter, 10.7 grams/liter of the sponge-like metallic tin as obtained in Example 1 was added to the plating solution and the resulting mixture was heated at 100° C. for 10 minutes. After heating, the obtained plating solution contained 21 grams/liter of stannous sulfate and 4 grams/liter of stannic sulfate.

EXAMPLE 4

To an old or used coloring electrolyte for aluminum consisting of 9.0 grams/liter of stannous sulfate, 11 grams/liter of stannic sulfate, 70 grams/liter of citric acid and 20 grams/liter of sulfuric acid and having a pH of 1.5 was added 21.4 grams/liter of the sponge-like metallic tin as obtained in Example 1. The resulting mixture was heated at 98° C. for 10 minutes. After heating, the obtained electrolyte contained 30 grams/liter of stannous sulfate and 4 grams/liter of stannic sulfate.

EXAMPLE 5

The procedure of Example 4 was repeated except that 100 mesh powdery tin reagent on the market was used in place of the sponge-like metallic tin. After heating, the obtained electrolyte contained 11.5 grams/liter of stannous sulfate and 9 grams/liter of stannic sulfate.

COMMERCIAL UTILIZATION

The process of this invention is greatly useful for the regeneration of an electro-plating bath or a coloring electrolyte for aluminum containing tin salts.

We claim:

1. A process for regenerating a stannous tin-containing electrolyte which contains stannic ions comprising if said electrolyte is not acidic, adding sufficient acid to said electrodlyte so that the electrolyte becomes acidic;

adding metallic tin having a high specific surface area selected from the group consisting of powdered tin, thin foils of tin, and sponge-like tin to said electrolyte; and heating said electrolyte containing said added metallic tin to from 80° C. to the boiling temperature of said electrolyte whereby stannic ions are reduced to stannous ions and metallic tin is oxidized to stannous ions thereby regenerating the electrolyte.

2. The process of claim 1 wherein the electrolyte to which the metallic tin is added has a pH of 4 or less.

3. The process of claim 1 wherein the electrolyte to which the metallic tin is added has a pH of from 0.5 to 2.

4. The process of claim 3 wherein sulfuric acid is added to said electrolyte to adjust the pH to the range of from 0.5 to 2.

* * * * *